United States Patent [19]

Best

[11] Patent Number: 4,798,246

[45] Date of Patent: Jan. 17, 1989

[54] PIPE SCRAPER

[76] Inventor: David M. Best, P.O. Box 14273, Houston, Tex. 77221

[21] Appl. No.: 41,230

[22] Filed: Apr. 22, 1987

[51] Int. Cl.[4] ..... E21B 37/02; B08B 9/02

[52] U.S. Cl. ..... 166/311; 166/173; 15/104.05; 134/23

[58] Field of Search ..... 166/170, 173, 174, 241, 166/242, 311; 15/104.05, 104.16, 104.8, 104.17; 134/23

[56] References Cited

U.S. PATENT DOCUMENTS

| | | | |
|---|---|---|---|
| 2,811,210 | 10/1957 | Guillot | 166/173 |
| 3,032,114 | 5/1962 | Best | 166/173 |
| 3,251,418 | 5/1966 | Condra | 166/173 |
| 3,326,294 | 6/1967 | Neilson | 166/173 |
| 4,189,000 | 2/1980 | Best | 166/173 |
| 4,291,764 | 9/1981 | Pampell | 166/173 |
| 4,558,738 | 12/1985 | Howard, Sr. | 166/173 |
| 4,648,447 | 3/1987 | Bishop et al. | 166/173 |

*Primary Examiner*—Jerome W. Massie
*Assistant Examiner*—Bruce Kisliuk
*Attorney, Agent, or Firm*—Jack W. Hayden

[57] ABSTRACT

A scraper for pipe is provided with scraper blades having arcuate scraper surfaces projecting therefrom with the blades movable radially between a contracted and expanded position which provides a first minimum diameter of the scraper surfaces in contracted position and a second maximum diameter when in expanded position which extends at least to the maximum internal pipe diameter, and an adjustment arrangement which enables said arcuate scraper blades to be adjusted radially to maintain said first and second diameters as the scraper surfaces wear.

44 Claims, 3 Drawing Sheets

FIG. 1
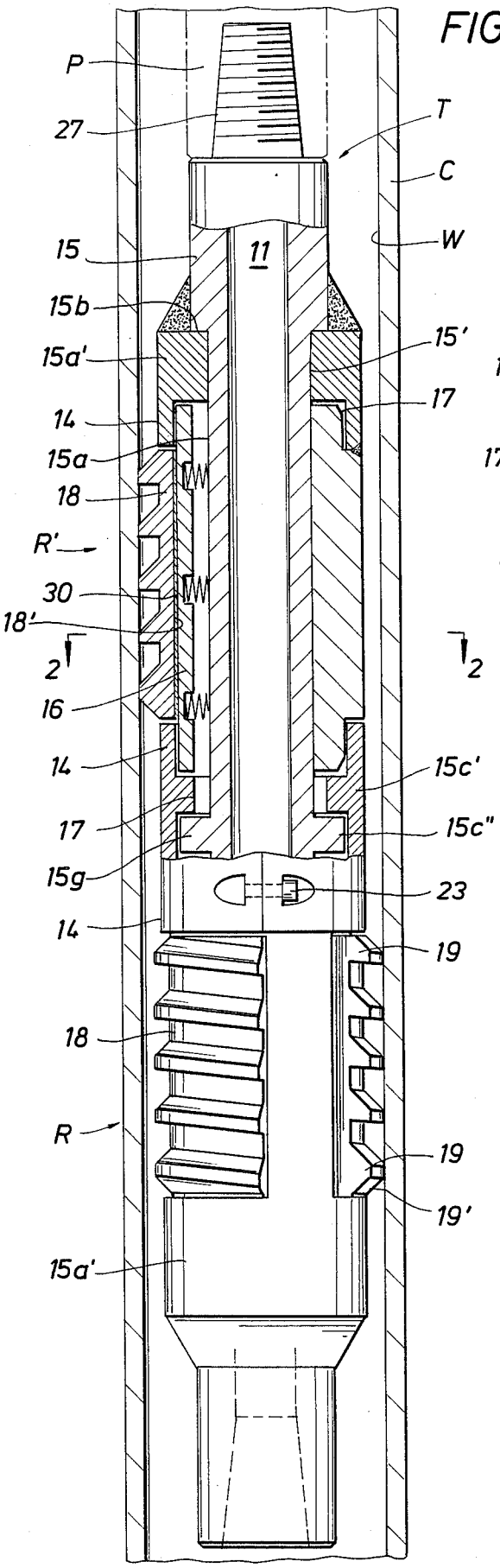
FIG. 2
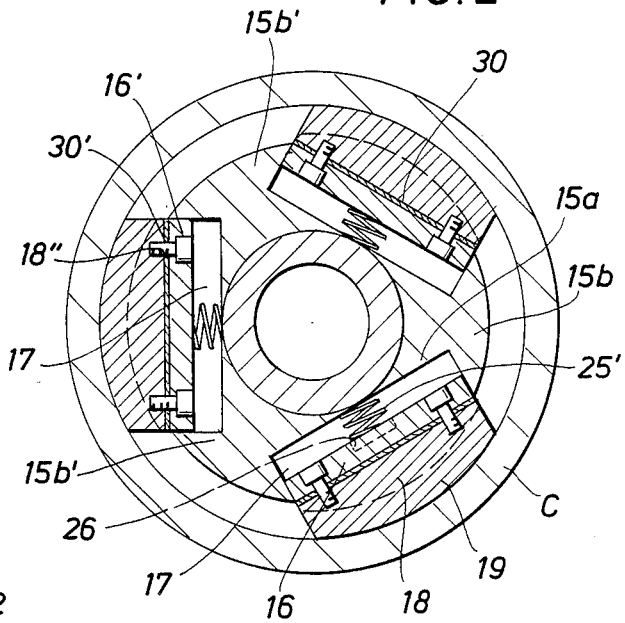
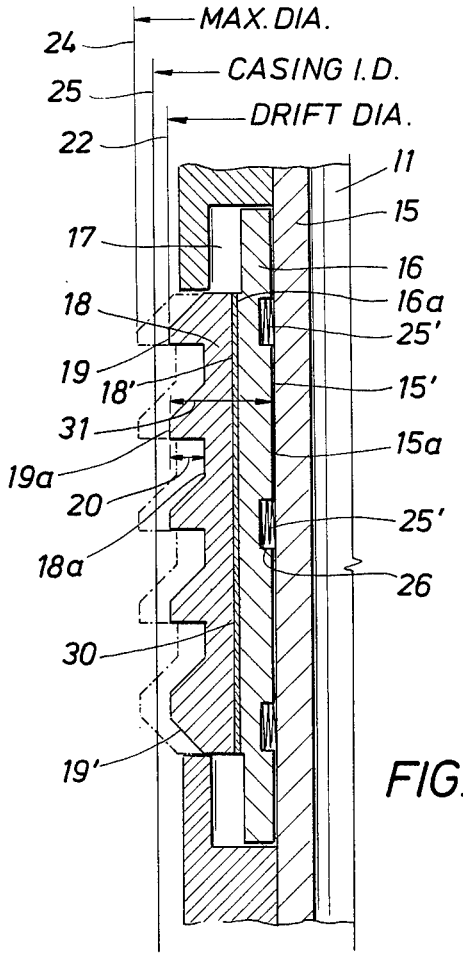
FIG. 3

FIG. 4
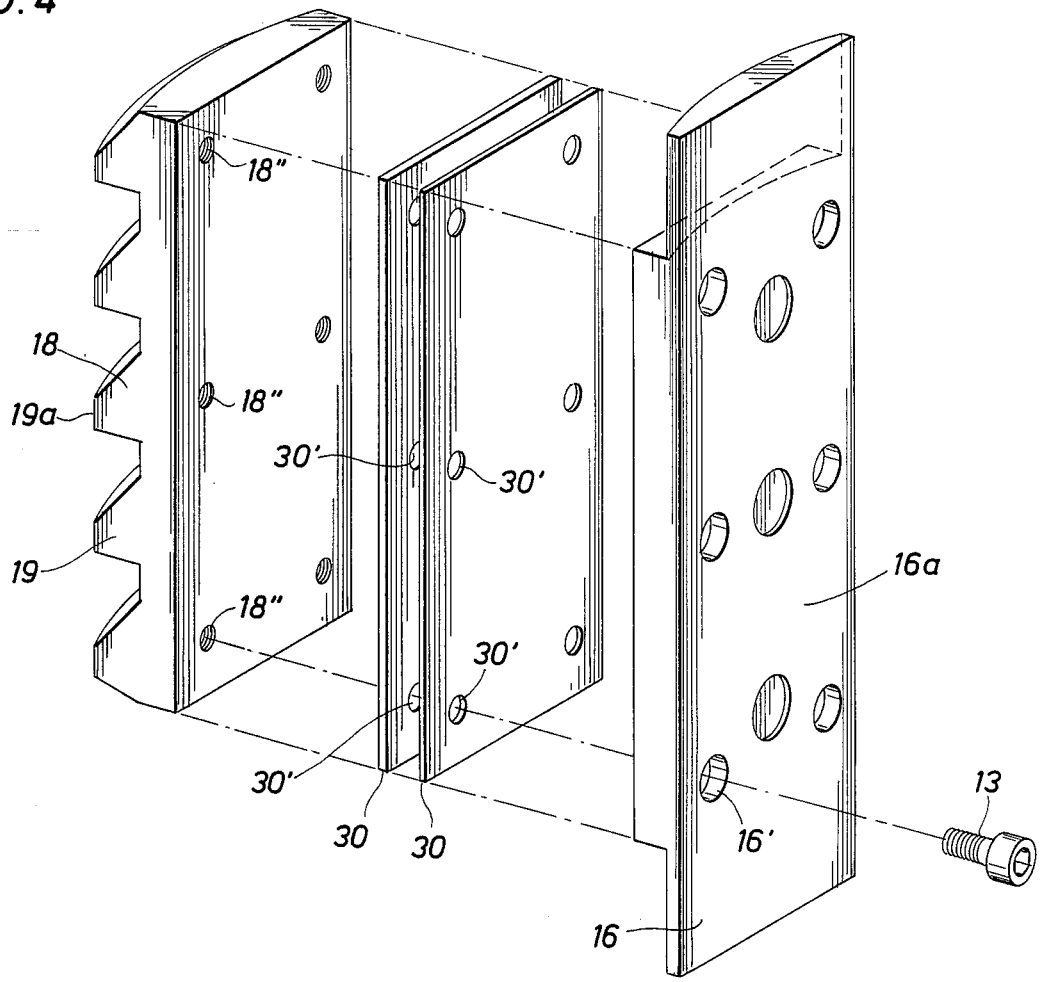
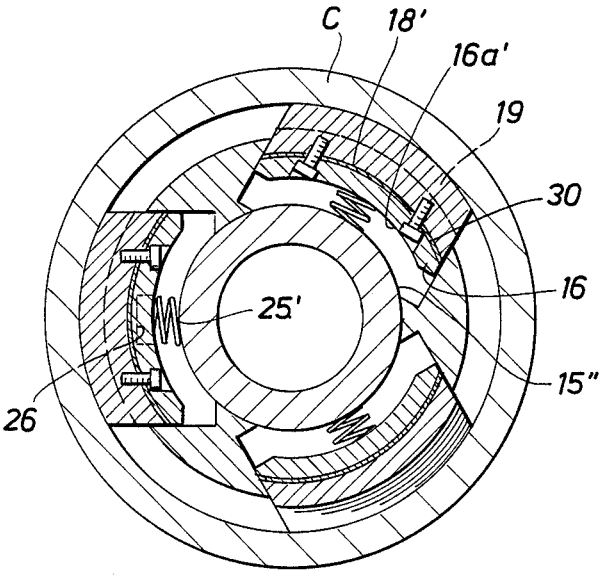
FIG. 5
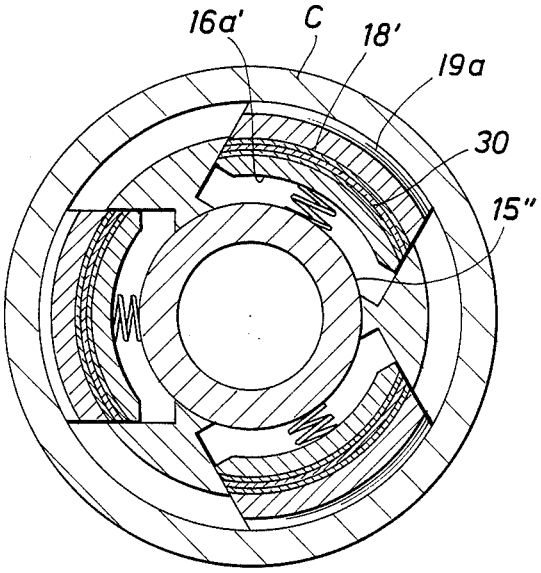
FIG. 6

FIG.7
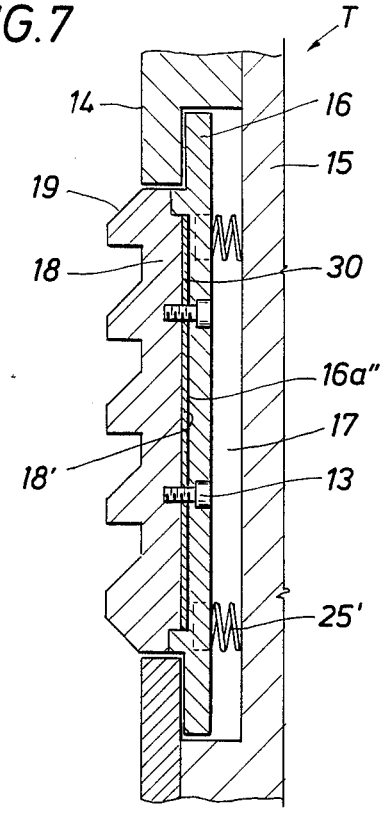
FIG.8
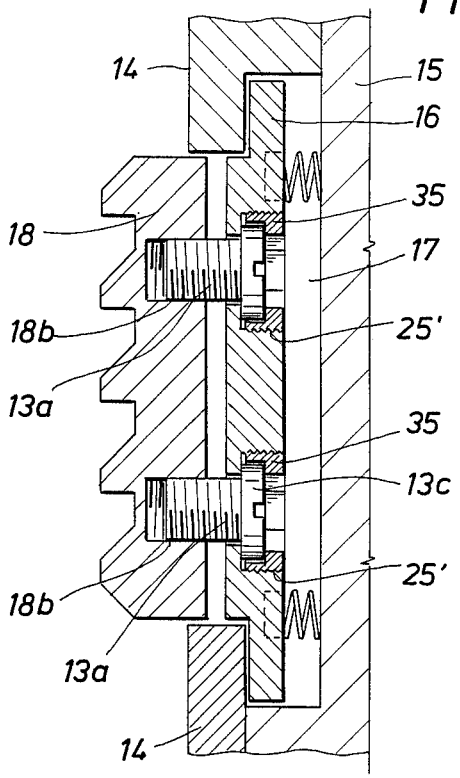
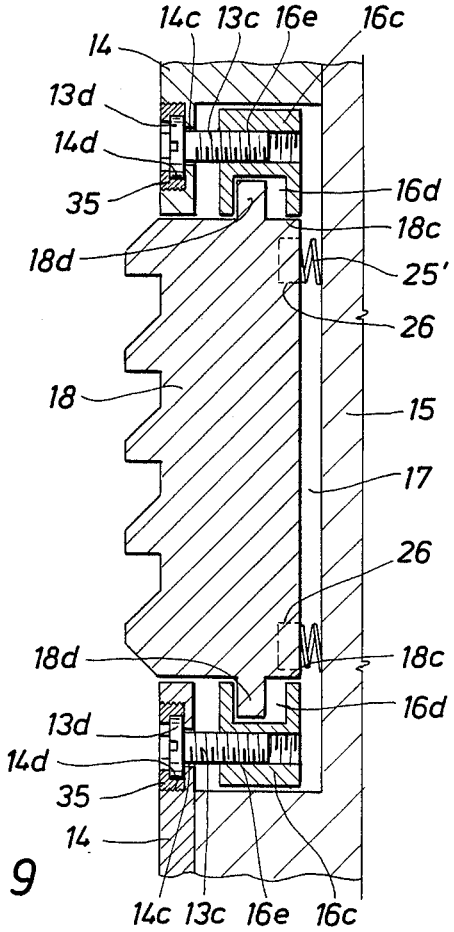
FIG.9
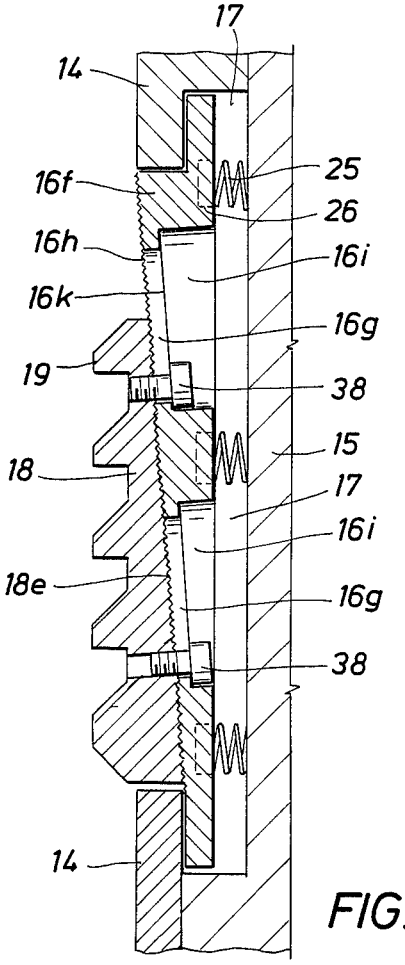
FIG.10

PIPE SCRAPER

FIELD OF THE INVENTION

The present invention relates to a scraper for pipe, and more particularly to a scraper for well pipe such as casing which includes an arrangement to adjust the scraper blades so that the scraper surfaces thereon are capable of contacting cement, scale, burrs and the like from adjacent the minimum permissible internal diameter of the pipe when the scraper blades are contracted to at least the full internal pipe diameter when the scraper blades are expanded to properly and actually scrape cement sheaths, scale, burrs and the like off the pipe wall between the minimum permissible internal pipe diameter clear out to at least the maximum internal pipe diameter when the scraper blades are expanded radially outward.

BACKGROUND OF THE INVENTION

Tubular members used for well pipe such as casing and the like come in a plurality of weights for each given pipe size thus providing multiple wall thicknesses and variable maximum internal pipe diameters within each pipe weight and size. The manufacturer of such pipe desires, from an economic view point, that the pipe wall be as thin as possible while still complying with various API standards for each particular weight and size pipe, one of such being that the pipe must have a minimum internal diameter that permits a drift bar or "rabbit" to pass therethrough. This is referred to as the "drift diameter" of that particular size and weight of pipe, such as casing and is generally slightly larger in diameter than the drift bar to assure passage of the drift bar therethrough. The "drift diameter" is that diameter of a tubular member which will pass an object of predetermined length and diameter through the pipe or tubular member from end-to-end.

It is not unusual for the internal diameter of pipe within any weight and size to vary from "drift diameter" to the maximum permissible internal pipe diameter throughout its length.

Of course, the manufacturer must still meet the other requirements such as, for example, concentricity, outer diameter, inner diameter and pressure requirements of the tubular member.

The scraping of well pipe, particularly such as casing, has heretofore been effected by a plurality of members supported on a body for radial movement in an attempt to scrape the pipe even though there are variations in the pipe internal diameter. The device is positioned in the well pipe and rotated and/or reciprocated to attempt to remove cement sheaths, burrs, mill scale, and other objects from the interior wall of the pipe so as to prevent damage to packers and other devices that may be used in the completion and production of the well.

Although such prior devices employ members that are radially contractible and expansible, the scraping surfaces on the scraper members or blades wear. Thus, there is no assurance that after the device has been used one or more times, scraping of the well pipe is effected from the minimum internal drift diameter to the full internal diameter as there is no way to assure that the scraper surfaces on the blades will always project outwardly into contact with the maximum internal diameter of the pipe. Thus, such devices must rely on the wobble, bounce or other kind of movement of the scraper tool as it is reciprocated or rotated in the well pipe in the hope that the scraper surfaces will contact and effect scraping of the interior pipe wall. As a result packers or other devices lowered into the well may be damaged or incapable of holding well pressure or being properly positioned by debris which is not removed and remains on the interior pipe wall.

More recently in an endeavor to overcome this problem a device employing scraper blades that are adjustable radially to a fixed location on a tapered surface has been employed, but such arrangement does not permit the scraper blade to expand from the fixed position, and the initial fixed position of the scraper blade can, generally speaking, be maintained approximately only at drift diameter since if it is larger than drift diameter there is no assurance that it can be lowered into and manipulated in the pipe. Thus, while such arrangement may contract and scrape the minimum internal diameter of the pipe, that is, the drift diameter of a pipe, the maximum internal diameter of the pipe is not necessarily engaged and scraped by the fixed blade.

Other problems with prior art scrapers such as those above mentioned include the fact that the construction provides an arrangement so there is substantially a line contact between the scraping surfaces and the interior pipe wall at its minimum internal diameter (drift diameter) as well as at its maximum internal pipe diameter since the radius of curvature at each diameter of the pipe is different, and may also be substantially different from the radius of curvature on the cutter surfaces.

Generally speaking, as a practical matter, a scraper blade manufacturer must manufacture scraper blades that cover ranges of pipe weights and therefore as the scraper surfaces on the blade wear the scraper surfaces may not contact and scrape lighter weight pipe in each size which reduces the effective range of pipe weights that can be effectively scraped by the scraper blades.

When the scraper surfaces on scraper blades will no longer scrape the heavier weight pipe in each pipe size, it is considered worn out, even though there may be substantial scraper surface depth remaining on the blade, and is either rebuilt or replaced with new pipe scraper blades.

SUMMARY OF THE INVENTION

The present invention is directed to a scraper which overcomes the above and other problems in that it provides a scraper which employs scraper blades that can be adjusted radially outward as the scraper surfaces thereon wear so as to not only maintain scraping contact with the interior of the pipe when it is at the minimum pipe diameter (drift diameter) but which also is expandable radially outwardly to assure scraping contact with the interior of the pipe surface when the pipe surface is at maximum internal pipe diameter so that the scraping surfaces may be used until they are completely worn down to the blade.

An object of this invention is to provide an adjustable arrangement for radially movable scraper blades with scraper surfaces thereon which enables the blades to be adjusted and maintained in a radial position to compensate for wear of the cutting surfaces to assure that the cutting surfaces will always be in position to contact and scrape cement, scales, burrs and the like between the minimum permissible internal and maximum internal pipe diameters and which enables the scraper blades to be employed effectively until the scraper surfaces are worn off substantially to the scraper blade.

Another object is to provide an internal pipe scraper which positively assures contact with and scrapes cement, scales, burrs and the like on pipe interiors between the minimum permissible internal diameter through the maximum internal diameter of a given pipe weight and size.

Another object is to provide an internal pipe scraper which positively contacts and scrapes cement, scales, burrs and the like on pipe interiors between the minimum internal diameter through the maximum internal diameter of any given pipe weight and size, and which enables a scraper blade to be employed until the scraper surfaces thereon are worn down to the scraper blade while still being capable of scraping between the pipe interior permissible drift diameter through maximum internal pipe diameter.

Another object is to provide a pipe scraper which can always be maintained and used in like-new condition and even though the cutting surfaces wear with assurance of scraping between the permissible and maximum internal pipe diameters within any predetermined pipe weight and size will.

Another object is to provide a pipe scraper which can always be maintained and used in like-new condition even though the cutting surfaces wear. This assures scraping and removal of cement, scale, burrs and the like which may be present on the pipe interior between the minimum permissible and maximum internal pipe diameters within any predetermined pipe weight and size, and which enables a full 360 degree bore of the pipe to be scraped without rotation.

A still further object is to provide a pipe scraper having scraping elements collapsible to drift diameter of the pipe and expandable to greater than full bore, or maximum internal diameter of the pipe for scraping between these two diameters, with adjustable means to maintain such scraping ability to remove cement, scale, burrs and the like on the pipe interior between the permissible minimum through the maximum diameter that may be encountered regardless of wear of the scraping elements.

Another object of the present invention is to provide a scraper for scraping the interior of pipe such as well pipe wherein a plurality of scraping teeth or surfaces on radially movable scraper blades provide a scraper assembly of a first outer diameter when contracted radially to scrapingly engage and remove cement, scale, burrs and the like on the pipe interior adjacent drift diameter and which scraper assembly also provides a second outer diameter when the scraper blades are radially expanded to scraping contact with the pipe interior at its maximum internal diameter, and means to adjust and maintain said scraper blades in position as the scraping surfaces thereon wear to positively assure that such scraping surfaces will engage and scrape any cement, scale, burrs and the like on of the pipe wall adjacent at drift diameter as well as maintaining scraping contact when the scraper blades are moved radially outward to at least the maximum internal pipe diameter.

Yet another object of the present invention is to provide a scraper arrangement for well pipe which can be adjusted to accommodate for wear of the scraping surfaces to assure that the scraper surfaces will always contact and remove cement, scale, burrs and the like from the pipe interior wall through at least its maximum internal pipe diameter until such scraping surfaces are substantially completely worn off to the surface of the scraper blade from which they project.

Yet another object of the present invention is to provide a method for scraping pipe wherein the scraping surfaces which project from scraper blades may be adjusted periocically radially outward of the support which lowers them into the pipe so that as such scraping surfaces wear, they may always maintain contact with the maximum internal pipe diameter when the scraping blades are moved radially outwardly to assure scraping contact between the scraping surfaces and any cement, scale, burrs and the like on the pipe interior at its minimum permissible internal and through the maximum internal pipe diameter.

Other objects and advantages of the present invention will become apparent from the consideration of the following description and drawings.

BRIEF DESCRIPTION OF THE DRAWINGS

FIG. 1 is a half-sectional view partly in elevation illustrating an embodiment of the present invention;

FIG. 2 is a sectional view on the line 2—2 of FIG. 1 illustrating further structural details of the FIG. 1 embodiment;

FIG. 3 is a partial sectional view illustrating a portion of the mandrel and support arrangement of one of the scraper blades shown in FIG. 2 and demonstrating the drift diameter and maximum internal diameter of a pipe and also representing the maximum expanded diameter of the scraper blade;

FIG. 4 is an exploded view illustrating the support means, and one form of the means to adjust the scraper blade radially, and the scraper blade of FIG. 1;

FIG. 5 is a sectional view illustrating the arrangement when the support means and the means to adjust is an arcuate plate-like arrangement;

FIG. 6 is a sectional view similar to FIG. 5 but illustrating an arrangement when a plurality of adjustment plate means are employed;

FIG. 7 illustrates an alternate embodiment of the invention;

FIG. 8 illustrates another alternate embodiment of the invention;

FIG. 9 illustrates still another alternate embodiment of the invention; and

FIG. 10 illustrates yet another alternate embodiment of the invention.

DESCRIPTION OF THE PREFERRED EMBODIMENTS

Attention is first directed to FIG. 3 of the drawings wherein a mandrel 15 is illustrated with a bore 11 therethrough. A support means 16 is positioned in a recess 17 formed in the mandrel 15 and any desired number of circumferentially spaced recesses 17 may be provided to form an annular row about the mandrel. The support means 16 supports a scraper blade 18 in each of the recesses 17, and the blade 18 is provided with scraper surface means or teeth 19 thereon that project outwardly from the outer scraper blade surface 18' to provide a scraper surface depth or tooth depth as represented at 20 by the arrow which extends from the surface **18*a* to the outermost edge 19*a* of the scraper surface means or cutter teeth 19 as shown in FIG. 3**.

The minimum acceptable or permissible internal pipe diameter of a given weight and pipe size is, as noted previously, termed the drift diameter and is represented by the line 22 which approximately coincides with the outermost edges or surfaces **19*a* on the scraping surfaces or teeth 19 when the blade 18 is in substantially collapsed position so that the scraping surfaces 19 may scrapingly engage any cement, scale, burrs and the like which extend from the pipe wall interior to drift diameter. The permissible maximum internal pipe diameter for a given weight and pipe size is represented by the line 25 and is shown as being radially displaced outwardly from, and is larger than the drift diameter 22. The maximum diameter to which the outer edge 19***a* of surfaces 19 may be radially expanded for a scraper tool for use in a given pipe weight and size is represented by the line 24 which is radially outward of the maximum permissible pipe diameter represented at 25 for each given pipe weight and size. The radial expansion of the scraper blades is effected by suitable means such as resilient means such as the springs 25' which rest or abut the bottom surface 15*a* of each recess 17 formed on the mandrel 15. The springs 25' are also received in the recesses 26 formed in the support means or member 16 as shown.

The invention will be described in detail as it may be used in well bore pipe, but such description is by way of example only, as the invention may be employed in any pipe which requires scraping.

A pipe such as a casing C for a well bore is illustrated in FIG. 1 in which is received the scraper tool referred to generally by the letter T that is provided with suitable means such as the threaded pin 27 whereby the tool T may be connected with a well string or pipe P so that the tool can be lowered into the casing C for rotation and reciprocation to scrape the interior wall W thereof as desired. The scraper tool which receives the blades and arrangement of the present invention may be formed in any suitable manner, such as that shown in my prior U.S. Pat. No. 4,189,000.

The mandrel 15 extends longitudinally and is provided with a suitable number of rows of circumferentially spaced recesses 17 for receiving the scraper blades 18 having scraping surface means 19 to effect scraping of the interior pipe wall W. At least one row of scraper blades is employed, and additional rows may be employed as necessary, with two rows R and R' illustrated in FIG. 1.

In FIG. 1, the mandrel 15 is shown as being provided with a reduced portion 15' extending between shoulders 15*b* the upper one of which is shown in FIG. 1 adjacent each end of the mandrel. An annular member 15*a'* is secured by any suitable means such as welding adjacent each shoulder 15*b* and includes longitudinally projecting portions 15*b'* that are circumferentially spaced about the mandrel 15 to form the recesses 17. The members 15*a'* also include annular skirt portions 14 between the projecting portions 15*b'* which are spaced radially from the bottom surface 15*a* of each recess and overhang the adjacent recess end to aid in retaining the support means 16 and blade 18 in position on the mandrel without interferring with the radial contraction and expansion thereof.

An annular shoulder 15*g* on the mandrel 15 separates the reduced diameter portion 15' into two portions so that the members 15*a'* adjacent each shoulder 15*f* form the rows of recesses 17 about mandrel 15. The members 15*a'* are offset circumferentially on mandrel 15 as represented in FIG. 1 so that the recesses 17 in one row are aligned with the projections 15*b'* on the other member 15*a'* in the adjacent row whereby the scraper blades 18 in each row cooperate to provide a full 360° scraping coverage of the pipe wall interior.

While three recess 17 are shown in each member 15*a'*; any suitable number may be employed. Also the recess bottoms 15*a* may be flat or arcuate as will be described.

An intermediate removable member 15*c'* is provided with an annular recess 15*c''* to receive annular projection 15*g* when 15*c'* is positioned on mandrel 15. It also includes skirt portions 14 at each end that overhang the other end of each recess 17 and further aid in maintaining support means 16 and blades 18 in operating position on mandrel 15. It is split longitudinally and the two portions may be held in place on mandrel 15 by suitable means such as screws 23. In assembly of the tool T, the blades 18 are secured to support means 16 and then inserted in the rows of recesses 17 and then member 15*c'* is secured in position to retain the scraper blades in position. As noted previously, the overlapping portions 14 on retainers or members 15*a'* and 15*c'* are radially spaced a suitable amount from the bottom surface 15*a* of each of the recesses 17 to accommodate the radial expansion and contraction of blades 18 so as not to interfere with scraping operations. The foregoing accommodates free radial expansion and contraction of blades 18 from full contracted position represented in FIG. 3 where the scraper blade 18 that is secured to the support blade or means 16 is in collapsed position adjacent the bottom surface 15*a* of recess 17 on or immediately adjacent mandrel 15 to expanded position where the cutter surfaces 19 engage at least the maximum pipe diameter represented at 25.

It will be noted that the support means 16 extends beyond the scraper blades 18 mounted thereon so that such extensions will serve as a means to engage the portions 14 for retaining the scraper blades assembled on the tool T during use.

The recesses 17 in the FIGS. 1–3 form are shown as having their bottom surface 15*a* formed on a chord of a circle and are flat. In the FIGS. 5 and 6 form, the bottom surface of the recesses 17 are shown as being arcuate as represented at 15''. The FIGS. 7–10 form may employ recesses 17 having flat or arcuate bottom surfaces as desired. As a practical matter, where flat bottom surfaces 15*a* are employed in recesses 17, the adjacent surface 16*a* of support member or plate 16 will be flat, and where the bottom surface 15'' of recesses 17 is arcuate the adjacent surface 16*a'* of support member 16 will be arcuate. Also, if the bottom surface 15*a* is flat, member 16 will be a flat plate-like member, and the adjacent surface 18' on blade 18 is preferably flat. Where the bottom surface 15*a* of the recess is arcuate, the support 16 will be arcuate as will be the blade 18. When the recess bottom surface 15*a* is arcuate, it may actually be the outer surface of the reduced mmandrel portion 15'.

When the tool T is initially assembled, it is assembled so that when the scraper blades 18 are lowered into the casing C, the casing C will engage a surface on the lowermost of cutting surface 19' of cutting surface means 19 as referred to in FIGS. 1 and 3 to cause the scraper blades 18 to contract radially inwardly so that the tool T may be lowered into the casing C. The spring means 25' continues to urge the scraper blades 18 radially outwardly so that the outermost edge surfaces 19*a* of cutting surface means 19 scrapingly engage whatever cement, scale, burrs and the like may be present on the casing C from approximately the minimum drift diameter represented at 22 in FIG. 3 all the way through the maximum diameter position of the arcuate edges 19a of the outer surface means 19, such diameter being represented by the line 25 in FIG. 3.

When a scraper tool is first used, the cutting surfaces 19 thereon may initially contact the cement, scale, burrs and the like on the interior pipe at its maximum internal diameter as well as its minimum internal diameter, represented at 25 and 22 respectively, to scrapingly engage the interior pipe wall W, but as the scraper is used, the scraping surfaces 19 wear down. When this occurs there is no assurance that scraping of the interior wall W of the pipe other than at drift diameter is accomplished. This problem is aggravated by the fact that the interior pipe diameter may, and often does, vary between drift diameter and maximum internal diameter, and such variation is not readily noticable to the eye since the pipe may be 20 to 60 feet or longer in length.

To overcome this, the present invention employs suitable means to adjust and maintain the scraper blades 18 radially outward relative to the support means 16 or mandrel 15 so that the outermost surfaces 19*a* of the cutting surface means 19 will always assume the initial diameter that they assume when the tool is first assembled in new condition and prior to use.

In FIGS. 1–7, such means is shown as being in the form of plate-like members 30 that are positioned between the support 16 and the bottom surface 18' of the blade 18 so that as the cutting surface means 19 wears down, the blades 18 will be returned to their original radial extent represented by the arrow 31 in FIG. 3.

The plates 30 are preferably either flat or curved in cross-section depending on the contour of the support 16 and the bottom of recesses 17. Their thickness may also vary so that the desired number and arrangement of various thicknesses can be employed to adjust the scraper blades 16 radially outward the desired amount.

As previously noted, the support member or means 16 is secured to the scraper blade 18 and in FIG. 2 it will noted that suitable openings 16' are provided in the plates 16 for receiving screws 13 therethrough which also extend through openings 30' in the plate-like members 30 and into threaded openings 18'' in the scraper blades 18 whereby the support 16, plate-like member 30 and scraper blade 18 may be secured together as a laminated or layered unit.

The amount that the scraper blade 18 should be adjusted radially outward to accommodate for wear can be readily determined by initially measuring the radial extent of the support means 16 and scraper 18 when initially assembled, such radial extent being represented by the arrow 31 in FIG. 3 of the drawings. Thereafter the tool may be periodically checked when it is withdrawn from the casing C by measuring such dimension to determine the amount of adjustment that is required to return the dimension 31 to its initial radial extent when assembled and prior to use. This may be repeated until the scraping surfaces 19 are completely worn down to substantially the outer surface 18a on blade 18.

In FIG. 4 the support plate 16 is again shown and in this instance two plate-like members 30 are illustrated as being employed each of different thickness to attain the desired radial spacing of the scraper blade 18 so that the dimension from the outermost surface 19*a* on the cutting surfaces 19 to the base or bottom surface 16*a* of the support plate 16 can be adjusted and maintained as desired. Any suitable number of plates and plate thickness can be provided with a tool to attain the desired radial position.

In FIGS. 1–3, the plate-like members 30 are illustrated as being flat as are the support plates 16 and scraper blades 18. In FIGS. 5 and 6 the bottom surface 16*a'* of the support means 16 and the bottom surface 18' of the scraper blade are curved to conform with the curved surface 15'' of the mandrel 15. The outermost edge surfaces 19*a* of the scraping surfaces 19 on scraper blades 18 are arcuated and are preferably formed so that the radius of curvature of the outermost edge surfaces 19*a* when initially formed provides an arc that generally approximates the radius of curvature of the maximum internal pipe diameter to assure maximum surface contact between the interior pipe wall W and cutting surfaces 19.

In FIG. 7 the support plate 16 is shown as being provided with a recess 16*a''* for receiving the means 30 to adjust and maintain the radial extent represented by the arrow 31 in FIG. 3 of the drawings. In this arrangement the torque and shear loads are transmitted from the scraper blade 18 to the mandrel or body 15 of the scraper tool T.

In FIG. 8 an alternate form is illustrated for adjusting and maintaining the scraper blades 18 in the desired radial position as wear occurs. In such form the screws 13*a* serve as the means to adjust and maintain the scraper blade 18 in the desired radial position relative to support means 16 to accommodate for scraper surface wear. The enlarged openings 18*b* are threaded and receive the enlarged threaded screws 13*a*. As shown, the heads 13*c* of such screws rest on or abut the bottom of the threaded openings 25' and a lock nut 35 is threaded in the opening 25 to secure and maintain the screw in position to which it may be adjusted longitudinally along the threaded opening 18*b*.

In FIG. 9 the scraper blade 18 is again represented and in this arrangement the support for the scraper blade 18 is in the form of members 16*c* which are shown as generally U shaped to provide a recess or groove 16*d* which faces toward the respective adjacent ends 18*c* of the scraper blade 18. A projection or tongue 18*d* extends from each end 18*c* to be received in a respective recess 16*d* of the support 16*c*.

Threaded screws 13*c* extend into threaded openings 16*e* in each of the members 16*c* whereby rotation of the bolts 13*c* adjust the supports 16*c* radially which in turn moves the scraper blade 18 radially. The screws 13*c* extend through openings 14*c* in portions 14 which openings are enlarged as shown at 14*d* for receiving the enlarged screw head 13*d* and seating it at the juncture of the opening 14*c* with the enlarged opening 14*d* as shown. The screws 13*c*, after they have each been rotated to adjust each of the members 16*c* radially to accomplish the radial movement of the scraper blade 18 to adjust it and to maintain it at the desired radial position to attain the desired diameter, may be held in such position by the lock nuts 35 threadedly secured on top of the enlarged heads 13d in the enlarged openings 14*d*. Spring means 25' abutting mandrel 15 and received in recess 26 in scraper blade 18 tend to urge scraper blade 18 continually radially outward.

In FIG. 10, the means to adjust the cutter blade 18 to a desired radially extent to accommodate for wear includes the support member 16*f* which is shown as being wedge-shaped and having a knurled or serrated inclined surface 16*h* thereon. The members 16*f* may be positioned in the recesses 17 provided adjacent mandrel 15 in any suitable manner as previously described. The nether surface 18*e* of the blade 18 is tapered to conform to the general taper of the knurled or serrated top surface 16h of the support 16f. The scraper blade 18 may be adjusted radially by means of the screws 38 which extend through the longitudinal slots 16g formed in the surface 16h of support members 16f. In order to adjust the blade 18 the screws 38 are loosened and the scraper blade 18 moved along the surface 16 the desired longitudinal extent to accomplish the desired radial extension to compensate for wear of scraping surfaces 19 whereupon the screws 38 may be tightened to interlock the serrated surfaces 18e and 16h to adjust and maintain the scraper blade 18 in the radial position necessary to accommodate for wear and to assure scraping of the casing from the drift diameter to the maximum internal pipe diameter that may be encountered. If desired the recesses 16i formed in the support 16f beneath the slots 16g may have a bottom surface 16k generally parallel to the surface 16h which reduces the longitudinal extent of the screws 38 that might be otherwise required during adjustment of the scraper blade along the wedge-shaped support 16f.

From the foregoing description it can be appreciated that the present invention provides an arrangement to accommodate for wear of the scraper teeth or scraper cutting surfaces on a scraper blade and enables the same scraper blade to be employed to assure that contact with a pipe is maintained from at least minimum diameter which is drift diameter to the maximum internal diameter of a given pipe weight and size that may be encountered during scraping operations. Thus, the scraping surfaces may be maintained in their same radial position that they had when they were first assembled and prior to use and may be maintained in such radial position from time to time as necessary to assure scraping contact at minimum pipe diameter, that is drift diameter, as well as through maximum internal pipe diameter until the cutting surfaces are worn down substantially their entire depth or length represented by the arrow 20 in FIG. 3. It can be appreciated that the scraper surface 19 may assume any desired configuration and as illustrated they are arranged generally in the form of rows of cutting surfaces inclined at any angle to the longitudinal axis of the scraper blade 16.

The foregoing disclosure and description of the invention are illustrative and explanatory thereof, and various changes in size, shape and materials as well as in the details of the illustrated construction may be made without departing from the spirit of the invention.

What is claimed is:

1. A scraper for scraping the interior of pipe comprising scraping teeth on scraper blades, said scraping teeth having outer arcuate edges which form, prior to wear of said scraper teeth, a generally circular scraper assembly of an original outer diameter supported on a mandrel for radial expansion from said original outer diameter that is defined by a predetermined fully radially collapsed position of said circular scraper assembly adjacent said mandrel to an expanded position forming a second outer diameter radially outward relative to said original outer diameter and means to adjust and maintain said scraper blades radially outwardly relative to said mandrel so that as said arcuate scraper teeth wear, the scraper assembly maintains substantially said original outer diameter when said scraper blades are in said fully radially collapsed position and the scraper assembly also maintaining said second outer diameter when said scraper blades are in the expanded position until said scraping teeth are worn down substantially to said scraper blade.

2. A scraper for the interior of pipe which pipe has a drift diameter and a maximum internal diameter, the scraper having scraper blades and scraper teeth thereon for scraping from the drift diameter of the pipe to at least the maximum internal diameter of the pipe until said scraper teeth are worn down substantially to the scraper blades including:

an elongated hollow mandrel having recesses therein;

scraper blades having scraper teeth thereon supported in the recesses for a uniform amount of radial movement relative to said mandrel from the drift diameter to at least the maximum internal diameter until said scraper teeth are worn down substantially to said scraper blades;

resilient means abutting said scraper blades to urge said scraper blades radially outward of said mandrel from a fully collapsed position at substantially the drift diameter of the pipe toward an extended position radially outward to at least the maximum internal diameter of the pipe; and means positionable adjacent said scraper blades to adjust said scraper blades radially outward relative to said mandrel as said scraper teeth wear whereby said scraper teeth engage and scrape cement, scale, burrs and the like on the pipe from drift diameter through at least the maximum internal diameter of the pipe until said scraper teeth are worn down substantially to said scraper blade.

3. A scraper for engaging and scraping the interior of pipe which pipe has a drift diameter and a maximum internal diameter, the scraper being capable of expanding and scraping from the drift diameter of the pipe to at least the maximum internal diameter of the pipe including:

an elongated hollow mandrel having recesses therein;

scraper blades supported in the mandrel recess for radial movement relative to said mandrel;

said scraper blades having scraper surface means projecting therefrom;

means on said mandrel to maintain said scraper blades in said mandrel recesses and accommodating a uniform amount of radial movement of said scraper blades relative to said mandrel from the drift diameter to at least the maximum internal pipe diameter until said scraper surface means are worn down substantially to said scraper blades;

resilient means abutting said scraper blades to urge said scraper blades radially outward of said mandrel from a fully collapsed position at substantially the drift diameter of the pipe toward an extended position radially outward to at least the maximum internal diameter of the pipe; and means positionable adjacent said scraper blades for maintaining said scraper surface means in contact with cement, scale, burrs and the like on the pipe interior from the minimum internal pipe diameter through at least the maximum internal pipe diameter until said scraper teeth are worn down substantially to said scraper blade.

4. The scraper of claim 2 or claim 3 wherein said mandrel has at least two longitudinally spaced rows of circumferentially spaced recesses with the recesses in one row being offset circumferentially from the recesses in the other row.

5. The scraper of claim 3 wherein said scraper surface means has outer edges, said outer edges forming an arc whose radius of curvature at all positions of said scraper surface means between collapsed position to extended position of said scraper blades provides maximum surface contact between said scraper surface means outer edges and the interior pipe surface between said collapsed and extended positions of said scraper blades.

6. A scraper for scraping the interior of a pipe which pipe has a predetermined minimum diameter and a maximum internal diameter, the scraper including scraper blades, arcuate surface means projecting from said scraper blades a mandrel, support means for supporting said blades on said mandrel for radial movement from a predetermined minimum diameter to at least the maximum internal pipe diameter, means to adjust said scraper blades on the mandrel which adjusts said scraper surface means radially outward and means accommodating the same amount of radial movement of said scraper surface means at said predetermined minimum diameter and also at least to said maximum internal pipe diameter until said scraper surface means are worn off said scraper blade.

7. In a scraper for scraping the interior of a pipe which pipe has a predetermined minimum diameter and a maximum internal diameter and the scraper having arcuate surface means projecting from a scraper blade which is supported on a mandrel for radial movement from a predetermined minimum diameter to at least the maximum internal pipe diameter, the invention comprising means to adjust said scraper blade on the mandrel which adjusts said scraper surface means radially outward, means on the mandrel for providing the same amount of radial movement of said scraper surface means from said predetermined minimum diameter at least to said maximum internal pipe diameter until said scraper surface means are substantially worn off and said scraper surface means having a radius of curvature to assist in maintaining maximum surface contact between said scraper surface means and cement, scale, burrs and the like on the pipe interior from said predetermined minimum diameter through at least said maximum internal pipe diameter.

8. The scraper of claims 1 or 2 wherein said means to adjust includes plate-like members of predetermined thickness for positioning adjacent said scraper blades.

9. The scraper of claims 1 or 2 wherein said means to adjust includes members threadedly engaged with the scraper blades and adjustable by rotation to move and position said scraper blades radially.

10. The scraper of claims 1 or 2 wherein said means to adjust includes support means for said scraper blades and means to move and position said support means radially which in turn adjusts and positions said scraper teeth radially.

11. The scraper of claims 1 or 2 wherein said means to adjust includes wedge-shaped support means; said scraper blades having a tapered surface conforming generally with the wedge-shaped support means whereby said scraper blades are adjusted radially by moving them longitudinally along said wedged-shaped support means; and means to lock said scraper blades at desired positions longitudinally along said wedge-shaped support means to thereby move and position the scraper blades radially outward as said scraper teeth wear.

12. In a scraper for scraping the interior of pipe from substantially the drift diameter to at least maximum internal diameter of the pipe, wherein the scraper includes scraper blade means with projecting scraper surface means thereon, the invention comprising: mandrel means including support means to support said scraper blade means for the same amount of radial movement of said blade means relative to said mandrel means from a first position defined by a substantially collapsed position adjacent the pipe drift diameter to second position defined by a substantially extended position to at least the pipe maximum internal diameter; and means to reposition the cutter blade means outwardly relative to said mandrel means as said scraper surface means wear to maintain the scraper surface means projecting from said mandrel means for scraping contact with cement, scale, burrs and the like from adjacent the pipe drift diameter to at least the pipe maximum internal diameter as the scraping surface means wear off to substantially their full extent.

13. In a scraper for pipe wherein a mandrel is provided with movable support means and resilient means tending to urge the support means laterally outward from the mandrel from a collapsed position to an extended position, the improvement comprising scraper blade means for securing with the movable support means and movable therewith; projecting scraper surface means on said blade means; and means to adjust and maintain said projecting scraper surface means projecting a predetermined distance relative to the mandrel when the support means is in collapsed position for scraping contact of said scraper surface means with cement, scale, burrs and the like on the pipe from adjacent the collapsed position of the support means to at least the extended position of the support means.

14. A method of scraping pipe interiors having a permissible minimum and a maximum internal diameter and assuring contact from the minimum through at least the maximum internal pipe diameter comprising the steps of:

resiliently supporting scraper blades with scraper surfaces thereon on a support for a uniform amount of radial expansion and contraction between the minimum and maximum internal diameters;

positioning and moving the scraper blades and support interiorly of a pipe to scrape cement, scale, burrs and the like from the pipe interior; and removing the scraper blades and support from the pipe and adjusting the scraper blades relative to the support as the scraper surface means wear to maintain scraping contact with cement, scale, burrs and the like on the pipe from its minimum through at least its maximum internal diameter until the scraper surfaces are substantially worn off.

15. The method of claim 14 wherein the scraper blades are adjusted by positioning plate-like members adjacent the scraper blades.

16. The method of claim 14 wherein the scraper blades are adjusted by rotating members threadedly engaged with the scraper blades.

17. The method of claim 14 wherein the scraper blades are adjusted by moving and retaining the support in the adjusted position.

18. The method of claim 14 wherein the scraper blades are adjusted by moving the scraper blades longitudinally along the support and locking the scraper blades at desired positions longitudinally along the support.

19. The scraper of claim 3 wherein said means for maintaining includes plate-like members of predetermined thickness for positioning adjacent said scraper blades.

20. The scraper of claim 3 wherein said means for maintaining includes members threadedly engaged with the scraper blades and adjustable by rotation to move and position said scraper blades radially.

21. The scraper of claim 3 wherein said means for maintaining includes support means for said scraper blades and means to move said support means which in turn adjusts and positions said scraper surface means laterally relative to said mandrel.

22. The scraper of claim 3 wherein said means for maintaining includes wedge-shaped support means; said scraper blades having a tapered surface conforming generally with the wedged-shaped support means whereby said scraper blades are adjusted radially by moving them longitudinally along said wedged-shaped support means; and means to lock said scraper blades at desired positions longitudinally along said wedge-shaped support means to thereby move and position the scraper blades radially outward as said scraper surface means wear.

23. The scraper of claims 6 and 7 wherein said means to adjust includes plate-like members of predetermined thickness for positioning adjacent said scraper blades.

24. The scraper of claims 6 or 7 wherein said means to adjust includes members threadedly engaged with the scraper blades and adjustable by rotation to move and position said scraper blades radially.

25. The scraper of claims 6 or 7 wherein said means to adjust includes support means for said scraper blades and means to move and position said support means radially which in turn adjusts and positions said scraper surface means radially.

26. The scraper of claims 6 or 7 wherein said means to adjust includes wedge-shaped support means; said scraper blades having a tapered surface conforming generally with the wedged-shaped support means whereby said scraper blades are adjusted radially by moving them longitudinally along said wedged-shaped support means; and means to lock said scraper blades at desired positions longitudinally along said wedge-shaped support means to thereby move and position the scraper blades radially outward as said scraper surface means wear.

27. The scraper of claim 12 wherein said means to reposition includes plate-like members of predetermined thickness for positioning adjacent said scraper blades.

28. The scraper of claim 12 wherein said means to reposition includes members threadedly engaged with the scraper blades and adjustable by rotation to move and position said scraper blades radially.

29. The scraper of claim 12 wherein said means to reposition includes the support means for said scraper blades and means to move and position said support means radially which in turn adjusts and positions said scraper teeth radially.

30. The scraper of claim 12 wherein said means to reposition includes wedge-shaped support means; said scraper blades having a tapered surface conforming generally with the wedged-shaped support means whereby said scraper blades are adjusted radially by moving them longitudinally along said wedged-shaped support means; and means to lock said scraper blades at desired positions longitudinally along said wedge-shaped support means to thereby move and position the scraper blades radially outward as said scraper teeth wear.

31. The scraper of claim 13 wherein said means to adjust and maintain includes plate-like members of predetermined thickness for positioning adjacent said scraper blade means.

32. The scraper of claim 13 wherein said means to adjust and maintain includes members threadedly engaged with the scraper blade means and adjustable by rotation to move and position said scraper blade means radially.

33. The scraper of claim 13 wherein said means to adjust and maintain includes the support means for said scraper blade means and means to move and position said support means radially which in turn adjusts and positions said scraper surfaces radially.

34. The scraper of claim 13 wherein said means to adjust and maintain includes wedge-shaped support means; said scraper blade means having a tapered surface conforming generally with the wedged-shaped support means whereby said scraper blade means are adjusted radially by moving it longitudinally along said wedged-shaped support means; and means to lock said scraper blade means at desired positions longitudinally along said wedge-shaped support means to thereby move and position the scraper blade means radially outward as said scraper surfaces wear.

35. The scraper of claim 3 wherein said means to maintain includes flat plate-like members of predetermined thickness for positioning adjacent said scraper blades.

36. The scraper of claim 3 wherein said means to maintain includes arcuate plate-like members of predetermined thickness for positioning adjacent said scraper blades.

37. The scraper of claim 6 wherein said means to adjust includes flat plate-like members of predetermined thickness for positioning adjacent said scraper blades.

38. The scraper of claim 6 wherein said means to adjust includes arcuate plate-like members of predetermined thickness for positioning adjacent said scraper blades.

39. The scraper of claim 7 wherein said means to adjust includes flat plate-like members of predetermined thickness for positioning adjacent said scraper blades.

40. The scraper of claim 7 wherein said means to adjust includes arcuate plate-like members of predetermined thickness for positioning adjacent said scraper blades.

41. The scraper of claim 12 wherein said means to reposition includes flat plate-like members of predetermined thickness for positioning adjacent said scraper blades.

42. The scraper of claim 12 wherein said means to reposition includes arcuate plate-like members of predetermined thickness for positioning adjacent said scraper blades.

43. The scraper of claim 13 wherein said means to adjust and maintain includes flat plate-like members of predetermined thickness for positioning adjacent said scraper blades.

44. The scraper of claim 13 wherein said means to adjust and maintain includes arcuate plate-like members of predetermined thickness for positioning adjacent said scraper blades.

* * * * *